United States Patent [19]

Moss et al.

[11] 4,144,035

[45] Mar. 13, 1979

[54] DETERGENT AND CORROSION INHIBITED MOTOR FUEL COMPOSITION

[75] Inventors: Philip H. Moss; Ernest L. Yeakey, both of Austin, Tex.

[73] Assignee: Texaco Development Corporation, New York, N.Y.

[21] Appl. No.: 890,105

[22] Filed: Mar. 27, 1978

[51] Int. Cl.[2] ..... C10L 1/22

[52] U.S. Cl. ..... 44/71; 252/394; 252/392

[58] Field of Search ..... 44/71; 252/394, 392; 260/534 M

[56] References Cited

U.S. PATENT DOCUMENTS

| | | | |
|---|---|---|---|
| 3,773,479 | 11/1973 | Dorn et al. | 44/71 |
| 3,980,448 | 9/1976 | Haemmerle et al. | 252/394 |
| 4,018,702 | 4/1977 | Boffardi et al. | 252/392 |
| 4,047,900 | 9/1977 | Dorn et al. | 44/71 |

*Primary Examiner*—Winston A. Douglas
*Assistant Examiner*—Y. Harris-Smith
*Attorney, Agent, or Firm*—Thomas H. Whaley; Carl G. Ries; James J. O'Loughlin

[57] ABSTRACT

Motor fuel composition comprising a mixture of hydrocarbons in a gasoline boiling range containing a compound represented by the formula:

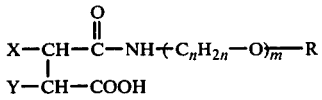

in which R is an aliphatic hydrocarbon radical having from about 8 to 20 carbon atoms, X and Y alternatively represent hydrogen and an aliphatic hydrocarbon radical having from 6 to 16 carbon atoms, n is an integer from 3 to 4 and m is an integer from 2 to 5.

6 Claims, No Drawings

DETERGENT AND CORROSION INHIBITED MOTOR FUEL COMPOSITION

BACKGROUND OF THE INVENTION

1. Field of the Invention

Modern internal combustion engine design is undergoing important changes to meet new federal standards concerning engine exhaust gas emissions. A major change in engine design recently adopted is the feeding of blow-by gases from the crankcase zone of the engine into the intake air supply to the carburetor rather than venting these gases to the atmosphere as in the past. Further changes adopted involve recycling of a part of the exhaust gases to the combustion zone of the engine in order to minimize objectionable emissions. The blow-by gases from the crankcase zone and the recycled exhaust gases both contain significant amounts of deposit-forming substances which promote the formation of deposits in and around the throttle plate area of the carburetor. These deposits restrict the flow of air through the carburetor at idle and at low speeds so that overrich fuel mixture results. This condition produces rough engine idling and stalling, and serves to increase the undesirable exhaust emissions which the engine design changes are intended to overcome.

Modern gasoline compositions are very highly refined products. Despite this, they contain minor amounts of impurities which can promote corrosion during the period that the fuel is transported and stored and even in the fuel tank, fuel lines and carburetor of the motor vehicle. A commercial motor fuel composition most contain a corrosion inhibitor to inhibit or prevent corrosion.

2. Description of the Prior Art

U.S. Pat. No. 3,905,781 discloses a motor fuel composition containing a substituted succinamic acid having the formula:

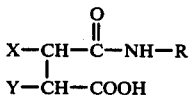

in which R is an aliphatic hydrocarbon radical having from about 12 to 20 carbon atoms, and X and Y alternately represent hydrogen and an aliphatic hydrocarbon radical having from 6 to 16 carbon atoms.

SUMMARY OF THE INVENTION

A class of aliphatic hydrocarbon-polyether substituted succinamic acid compounds are provided as carburetor detergents and corrosion inhibitors when employed in a liquid hydrocarbon fuel for an internal combustion engine. These compounds which are characterized by having an aliphatic hydrocarbon radical and a aliphatic hydrocarbon terminated polyether radical exhibit surprising effective carburetor detergency and corrosion inhibiting properties.

The fuel composition of the invention prevents or mitigates the problem of corrosion and deposits lay down in the carburetor of an internal combustion engine. When a gasoline of the invention is employed in a carburetor which already has a substantial build-up of deposits from prior operations, a rather severe test of the detergency property of a fuel composition, this gasoline is effective for removing substantial amounts of preformed deposits.

DESCRIPTION OF THE PREFERRED EMBODIMENTS

The aliphatic hydrocarbon-polyether substituted succinamic acid compound of the invention is represented by the formula:

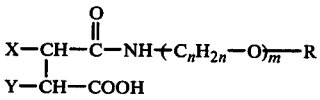

in which R is an aliphatic hydrocarbon radical having from about 8 to 20 carbon atoms, X and Y alternatively represent hydrogen and an aliphatic hydrocarbon radical having from 6 to 16 carbon atoms, n is an integer from 3 to 4 and m is an integer from 2 to 5.

A preferred reaction product of the invention is represented by the formula:

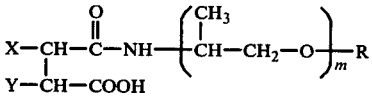

in which R has from 8 to 14 carbon atoms, X and Y have the values noted above and m is an integer from 2 to 3.

Particularly preferred compounds are those in which the aliphatic hydrocarbon radicals are branched-chain, saturated hydrocarbon radicals.

Methods for preparing the additive of the invention are well known and do not constitute part of this invention. In a preferred method, an olefinically unsaturated hydrocarbon is reacted with maleic anhydride to produce an alkenyl succinic anhydride. This is then reacted with an aliphatic polyether amine of suitable chain length in 1 to 1 mole proportions at a temperature below about 95° C. to produce an N-alkylpolyether alkenylsuccinamic acid.

The reaction from an alkenyl succinic anhydride where X, Y, R, n and m have the values noted above is illustrated by the following formulas:

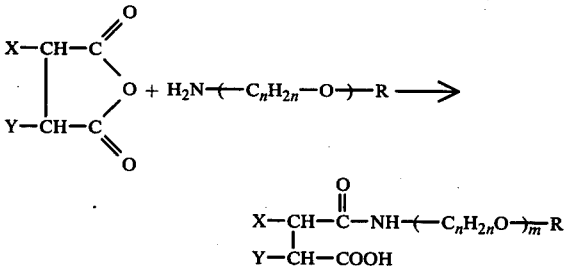

It will be appreciated that the product of the reaction can be a mixture of compounds conforming to the alternate versions of the formula given above. It will also be understood that mixtures of the prescribed compounds can be effective employed as additives in a motor fuel composition of the invention.

Examples of the effective carburetor detergents and corrosion inhibitors of this invention include the following:

N-[octyldipropoxy]-tetrapropenyl succinamic acid
N-[octyltripropoxy]-tetrapropenyl succinamic acid
N-[octyltetrapropoxy]-tetrapropenyl succinamic acid N-[decyldibutoxy]-hexadecenyl succinamic acid
N-[decyltributoxy]-hexadecenyl succinamic acid
N-[decyltetrabutoxy]-hexadecenyl succinamic acid
N-[dodecyldipropoxy]-hexadecenyl succinamic acid
N-[dodecyldipropoxy]-dipropenyl succinamic acid
N-[dodecyldipropoxy]-tripropenyl succinamic acid
N-[octadecyldipropoxy]-tripropenyl succinamic acid
N-[octadecyltripropoxy]-tripropenyl succinamic acid
N-[hexadecyldipropoxy]-octadecenyl succinamic acid The base fuel which is useful for employing the additive of the invention is a motor fuel composition comprising a mixture of hydrocarbons boiling in the gasoline boiling range. This base fuel may consist of straight-chain or branched-chain paraffins, cycloparaffins, olefins, and aromatic hydrocarbons and any mixture of these. The base fuel can be derived from straight-run naphtha, polymer gasoline, natural gasoline or from catalytically cracked or thermally cracked hydrocarbons and catalytically reformed stocks and boils in the range from about 80° to 450° F. The composition and the octane level of the base fuel are not critical. Any conventional motor fuel base can be employed in the practice of this invention.

In general, the additive of the invention is added to the base fuel in a minor amount, i.e., an amount effective to provide corrosion inhibition or carburetor detergency or both to the fuel composition. The additive is effective in an amount ranging from about 0.0002 to 0.2 weight percent based on the total fuel composition. An amount ranging from about 0.001 to 0.01 weight percent is preferred, the latter amounts corresponding to about 3 and 30 PTB (pounds of additive per 1000 barrels of gasoline) respectively.

The fuel composition of the invention may contain any of the additives normally employed in a motor fuel. For example, the base fuel may be blended with an anti-knock compound, such as a methyl-cyclopentadienyl manganese tricarbonyl or tetraalkyl lead compounds, including tetraethyl lead, tetramethyl lead, tetrabutyl lead, and chemical and physical mixtures thereof, generally in a concentration from about 0.025 to 4.0 cc per gallon of gasoline. The tetraethyl lead mixture commercially available for automotive use contains an ethylene chloride-ethylene bromide mixture as a scavenger for removing lead from the combustion chamber in the form of a volatile lead halide. The motor fuel composition may also be fortified with any of the conventional anti-icing additives, corrosion inhibitors, dyes and the like.

Gasoline blends are prepared from a typical base fuel mixed by adding specified amounts of the prescribed fuel additive of the invention. The additive of the invention is tested for its effectiveness in gasoline in the following performance tests.

The additive of the invention is tested for its effectiveness as a carburetor detergent in the Carburetor Detergency Test. This test is run on Chevrolet V-8 engine mounted on a test stand using a modified four barrel carburetor. The two secondary barrels of the carburetor are sealed and the feed to each of the primary barrels arranged so that an additive fuel can be run in one barrel and the base fuel run in the other. The primary carburetor barrels are also modified so that they have removable aluminum inserts in the throttle plate area in order that deposits formed on the inserts in this area would be conveniently weighed.

In the procedure designed to determine the effectiveness of an additive fuel to remove preformed deposits in the carburetor, the engine is run for period of time usually 24 to 48 hours using the base fuel as the feed to both barrels with engine blow-by circulated to an inlet in the carburetor body. The weight of the deposits on both sleeves is determined and recorded. The engine is then cycled for 24 additional hours with a suitable reference fuel being fed to one barrel, additive fuel to the other and blowby to the inlet in the carburetor body. The inserts are then removed from the carburetor and weighed to determine the difference between the performance of the additive and reference fuels in removing the preformed deposits. After the aluminum inserts are cleaned, they are replaced in the carburetor and the process repeated with the fuels reversed in the carburetor to minimize differences in fuel distribution and barrel construction. The deposit weights in the two runs are averaged and the effectiveness of the fuel composition of the invention is compared to the reference fuel which contains an effective detergent additive. The difference in effectiveness is expressed in percent, a positive difference indicating that the fuel composition of the invention was more effective than the commercial fuel composition.

The corrosion inhibiting properties of a gasoline composition of the invention is determined in a corrosion test designated the Colonial Pipeline Rust Test. In this test, a steel specimen, polished with non-waterproof fine emery paper is immersed in 300 ml of stirred test fuel at 100° F. for 30 min. Then 30 ml distilled water is added and stirred for 3.5 hours. The specimen is visually rated and a rating of 5% rust is considered passing.

The fuel composition of the invention will exhibit carburetor detergency and corrosion inhibiting properties when tested in the above-described tests.

I claim:

1. A motor fuel composition comprising a mixture of hydrocarbons in the gasoline boiling range and from about 0.0002 to 0.2 weight percent of an aliphatic hydrocarbon-polyether substituted succinamic acid represented by the formula:

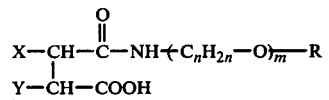

in which R is an aliphatic hydrocarbon radical having from about 8 to 22 carbon atoms, X and Y alternatively represent hydrogen and an aliphatic hydrocarbon radical having from 6 to 16 carbon atoms, n is an integer from 3 to 4 and m is an integer from 2 to 5.

2. A motor fuel composition according to claim 1 in which R represents a saturated aliphatic hydrocarbon radical having from 12 to 18 carbon atoms.

3. A motor fuel composition according to claim 1 in which R represents a branched-chain, saturated aliphatic hydrocarbon radical.

4. A motor fuel composition according to claim 1 containing from about 0.0001 to 0.01 weight percent of said reaction product.

5. A motor fuel composition according to claim 1 in which said reaction product is N,N'-[3-tridecoxypropyl]asparagine.

6. A motor fuel composition according to claim 1 in which said reaction product is N,N'-[3-decoxypropyl]-asparagine.

* * * * *